US010232243B2

(12) United States Patent
Bowers

(10) Patent No.: US 10,232,243 B2
(45) Date of Patent: Mar. 19, 2019

(54) ROCK CLIMBING TRAINING APPARATUS

(71) Applicant: Bruce Bowers, Honeyville, UT (US)

(72) Inventor: Bruce Bowers, Honeyville, UT (US)

( * ) Notice: Subject to any disclaimer, the term of this patent is extended or adjusted under 35 U.S.C. 154(b) by 246 days.

(21) Appl. No.: 15/404,507

(22) Filed: Jan. 12, 2017

(65) Prior Publication Data

US 2017/0197132 A1 Jul. 13, 2017

Related U.S. Application Data

(60) Provisional application No. 62/277,800, filed on Jan. 12, 2016.

(51) Int. Cl.

| | |
|---|---|
| ***A63B 69/00*** | (2006.01) |
| ***A63B 22/04*** | (2006.01) |
| ***A63B 22/00*** | (2006.01) |
| ***A63B 21/00*** | (2006.01) |
| *A63B 22/02* | (2006.01) |

(Continued)

(52) U.S. Cl.

CPC ..... *A63B 69/0048* (2013.01); *A63B 21/4007* (2015.10); *A63B 21/4009* (2015.10); *A63B 21/4011* (2015.10); *A63B 22/0023* (2013.01); *A63B 22/04* (2013.01); *A63B 69/0064* (2013.01); *A63B 21/4045* (2015.10); *A63B 22/0235* (2013.01); *A63B 24/0087* (2013.01); *A63B 2071/063* (2013.01); *A63B 2071/0625* (2013.01); *A63B 2071/0638* (2013.01); *A63B 2220/56* (2013.01); *A63B 2220/806* (2013.01); *A63B 2220/807* (2013.01);

(Continued)

(58) Field of Classification Search

CPC .. A63B 69/0048; A63B 22/04; A63B 22/4007

See application file for complete search history.

(56) References Cited

U.S. PATENT DOCUMENTS 4,822,029 A * 4/1989 Sarno ..... A63B 22/0002 482/120

4,848,737 A * 7/1989 Ehrenfield ..... A63B 21/157 482/52

(Continued)

FOREIGN PATENT DOCUMENTS

DE 4413335 A1 * 10/1995 ..... A63B 23/16

DE 20305805 10/2003

(Continued)

*Primary Examiner* — Nyca T Nguyen

(74) *Attorney, Agent, or Firm* — Kunzler, PC

(57) ABSTRACT

Disclosed herein is an exercise apparatus comprising a conveyor mechanism comprising a continuous track and a plurality of bars movable along the continuous track in a closed loop path. The plurality of bars extend lengthwise in a lateral direction across a width of the conveyor mechanism. The conveyor mechanism has a front side and a back side, opposite the front side. The plurality of bars move in a downward direction along the front side of the conveyor mechanism and in an upward direction along the back side of the conveyor mechanism. The upward direction and the downward direction are perpendicular to the lateral direction. The conveyor mechanism also comprises a plurality of carriage components movable along the plurality of bars in the lateral direction. The conveyor mechanism additionally comprises at least one hold coupled to each carriage component of the plurality of carriage components.

20 Claims, 5 Drawing Sheets

(51) Int. Cl.
*A63B 24/00* (2006.01)
*A63B 71/06* (2006.01)

(52) U.S. Cl.
CPC ..... *A63B 2220/808* (2013.01); *A63B 2225/09* (2013.01); *A63B 2225/50* (2013.01)

(56) References Cited

U.S. PATENT DOCUMENTS

| | | | | | |
|---|---|---|---|---|---|
| 5,112,043 | A * | 5/1992 | Gilfillian, Jr. | A63B 22/001 | 482/37 |
| 5,256,116 | A | 10/1993 | Robinson | | |
| 5,732,954 | A | 3/1998 | Strickler | | |
| 6,231,482 | B1 * | 5/2001 | Thompson | A63B 22/02 | 482/37 |
| 6,514,178 | B2 | 2/2003 | Vettori | | |
| 7,419,457 | B1 | 9/2008 | Sudeith et al. | | |
| 9,017,224 | B1 * | 4/2015 | Singley | A63B 22/001 | 482/52 |
| 2003/0013579 | A1 * | 1/2003 | Rennex | A63B 7/04 | 482/37 |
| 2011/0319230 | A1 | 12/2011 | Brendle | | |
| 2014/0228177 | A1 * | 8/2014 | Brewer | A63B 69/0048 | 482/37 |
| 2015/0057776 | A1 | 2/2015 | Skjaerseth et al. | | |

FOREIGN PATENT DOCUMENTS

| | | | | |
|---|---|---|---|---|
| DE | 102006029309 | | 12/2007 | |
| EP | 2055356 | | 8/2011 | |
| FR | 2686024 | A1 * | 7/1993 | A63B 69/0048 |
| WO | 8909635 | | 10/1989 | |
| WO | 2005049155 | | 6/2005 | |
| WO | 2005120660 | | 12/2005 | |

* cited by examiner

ROCK CLIMBING TRAINING APPARATUS

CROSS-REFERENCE TO RELATED APPLICATION

This application claims the benefit of U.S. Provisional Patent Application No. 62/277,800, filed Jan. 12, 2016, which is incorporated herein by reference.

FIELD

The present disclosure relates generally to exercise equipment, and more particularly to a training apparatus configured to help users imitate actions associated with rock climbing.

BACKGROUND

Rock climbing is a fun and exhilarating activity that allows people to explore the outdoors in a unique fashion while also providing beneficial exercise to the participants. However, in order to achieve an adequate level of proficiency in rock climbing, participants need to learn rock climbing skills and maneuvers and train in a safe and controlled environment.

Conventional rock climbing training is inconvenient, as participants usually need to travel to a specialized rock climbing gym, which has an artificial rock climbing wall, or to an actual rock formation in nature in order to participate in rock climbing training. Trips to and from training locations can be expensive and time consuming. While there are some conventional rotating climbing walls that can be assembled in a user's home, they often require extensive space in a room (e.g., raised ceilings, etc.) and are not well configured to provide adequate training and exercise.

SUMMARY

The subject matter of the present disclosure has been developed in response to the present state of the art associated with rock climbing training. Accordingly, the subject matter of the present disclosure has been developed to provide an apparatus for training rock climbers or providing rehabilitation that overcomes many, all, or some shortcomings of the prior art.

Disclosed herein is an exercise apparatus comprising a conveyor mechanism comprising a continuous track and a plurality of bars movable along the continuous track in a closed loop path. The plurality of bars extend lengthwise in a lateral direction across a width of the conveyor mechanism. The conveyor mechanism has a front side and a back side, opposite the front side. The plurality of bars move in a downward direction along the front side of the conveyor mechanism and in an upward direction along the back side of the conveyor mechanism. The upward direction and the downward direction are perpendicular to the lateral direction. The conveyor mechanism also comprises a plurality of carriage components movable along the plurality of bars in the lateral direction. The conveyor mechanism additionally comprises at least one hold coupled to each carriage component of the plurality of carriage components. The preceding subject matter of this paragraph characterizes example 1 of the present disclosure.

The plurality of carriage components is movable along the plurality of bars in the lateral direction when the plurality of bars are moving in the upward direction along the back side of the conveyor mechanism. The plurality of carriage components is non-movable along the plurality of bars in the lateral direction when the plurality of bars are moving in the downward direction along the front side of the conveyor mechanism. The preceding subject matter of this paragraph characterizes example 2 of the present disclosure, wherein example 2 also includes the subject matter according to example 1, above.

The exercise apparatus further comprises a repositioning system on the back side of the conveyor mechanism configured to laterally reposition the plurality of carriage components along the plurality of bars. The preceding subject matter of this paragraph characterizes example 3 of the present disclosure, wherein example 3 also includes the subject matter according to example 2, above.

The repositioning system comprises a plurality of guide rails. The plurality of carriage components engage the guide rails as the plurality of carriage components move with the plurality of bars in the upward direction along the back side of the conveyor mechanism. The guide rails urge movement of the plurality of carriage components in the lateral direction along the plurality of bars. The preceding subject matter of this paragraph characterizes example 4 of the present disclosure, wherein example 4 also includes the subject matter according to example 3, above.

The repositioning system further comprises at least one translational actuator selectively operable to laterally pushes the plurality of carriage components along the plurality of bars. The preceding subject matter of this paragraph characterizes example 5 of the present disclosure, wherein example 5 also includes the subject matter according to example 4, above.

Each bar of the plurality of bars comprises first engagement features on only a first side of the bar. Each carriage component of the plurality of carriage components comprises second engagement features. The first engagement features of each bar and the second engagement features of each carriage component are engageable, only when the plurality of bars are moving in the downward direction along the front side of the conveyor mechanism, to prevent relative movement between the bar and the carriage component. The preceding subject matter of this paragraph characterizes example 6 of the present disclosure, wherein example 6 also includes the subject matter according to any one of examples 4 or 5, above.

The continuous track of the conveyor mechanism has one of an obround shape or an ovular shape. The preceding subject matter of this paragraph characterizes example 7 of the present disclosure, wherein example 7 also includes the subject matter according to any one of examples 1-6, above.

The plurality of carriage components are slidably engaged with the plurality of bars. The preceding subject matter of this paragraph characterizes example 8 of the present disclosure, wherein example 8 also includes the subject matter according to any one of examples 1-7, above.

The exercise apparatus further comprising spacers coupled to the plurality of bars, wherein the spacers are disposed between adjacent bars of the plurality of bars to prevent fingers and clothing from being pinched between adjacent bars. The preceding subject matter of this paragraph characterizes example 9 of the present disclosure, wherein example 9 also includes the subject matter according to any one of examples 1-8, above.

The exercise apparatus further comprises a body support mechanism configured to at least partially suspend a user in the air. The preceding subject matter of this paragraph characterizes example 10 of the present disclosure, wherein example 10 also includes the subject matter according to any one of examples 1-9, above.

The body support mechanism is adjustable to provide different magnitudes of supportive force. The preceding subject matter of this paragraph characterizes example 11 of the present disclosure, wherein example 11 also includes the subject matter according to example 10, above.

The body support mechanism is configured to engage at least one of a waist of the user or knees of the user or torso of the user. The preceding subject matter of this paragraph characterizes example 12 of the present disclosure, wherein example 12 also includes the subject matter according to any one of examples 10 or 11, above.

The body support mechanism comprises a harness. The preceding subject matter of this paragraph characterizes example 13 of the present disclosure, wherein example 13 also includes the subject matter according to any one of examples 10-12, above.

The conveyor mechanism is a first conveyor mechanism. The exercise apparatus further comprises a second conveyor mechanism. A rotational speed of the first and second conveyor mechanisms are independently adjustable. The preceding subject matter of this paragraph characterizes example 14 of the present disclosure, wherein example 14 also includes the subject matter according to any one of examples 1-13, above.

At least one of each carriage component or each hold comprises a pressure sensor configured to determine if a user is gripping the hold. The preceding subject matter of this paragraph characterizes example 15 of the present disclosure, wherein example 15 also includes the subject matter according to any one of examples 1-14, above.

Each hold is moveable, relative to the carriage component to which the hold is coupled, in a protruding direction perpendicular to the upward direction, the downward direction, and the lateral direction. The preceding subject matter of this paragraph characterizes example 16 of the present disclosure, wherein example 16 also includes the subject matter according to any one of examples 1-15, above.

The exercise apparatus further comprises a surface material coupled to and at least partially covering the plurality of bars. The preceding subject matter of this paragraph characterizes example 17 of the present disclosure, wherein example 17 also includes the subject matter according to any one of examples 1-16, above.

The exercise apparatus further comprises a tilt mechanism defining a fixed axis. The conveyor mechanism is tiltable about the fixed axis of the tilt mechanism. The preceding subject matter of this paragraph characterizes example 18 of the present disclosure, wherein example 18 also includes the subject matter according to any one of examples 1-17, above.

Also disclosed is a method of exercising a user. The method comprises rotating a plurality of bars down a first side in a first direction and rotating the plurality of bars up a second side in a second direction opposite the first direction. The method also comprises movably coupling a plurality of holds to the plurality of bars. The method further comprises moving the plurality of holds in a third direction, perpendicular to the first direction and the second direction, along the plurality of bars into first positions while the plurality of bars are rotating up the second side in the second direction. The method additionally comprises releasably fixing the plurality of holds in the first positions while the plurality of bars are rotating down the first side in the first direction. The preceding subject matter of this paragraph characterizes example 19 of the present disclosure.

The method further comprises moving the plurality of holds in the third direction along the plurality of bars from the first positions into second positions, different than the first positions, while the plurality of bars are rotating up the second side in the second direction. The method also comprises releasably fixing the plurality of holds in the second positions while the plurality of bars are rotating down the first side in the first direction. The preceding subject matter of this paragraph characterizes example 20 of the present disclosure, wherein example 20 also includes the subject matter according to example 19, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter of the present disclosure will be readily understood, a more particular description of the subject matter will be rendered by reference to specific embodiments that are illustrated in the appended drawings. Understanding that these drawings depict only typical embodiments of the subject matter of the present disclosure and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Illustrated in FIGS. 1-9 are several representative embodiments of a rock climbing training apparatus. As described herein, the rock climbing training apparatus provides several significant advantages and benefits over other rock climbing training devices and methods. However, the recited advantages are not meant to be limiting in any way, as one skilled in the art will appreciate that other advantages may also be realized upon practicing the present disclosure. For example, while the rock climbing training apparatus of the present disclosure can be used for learning, developing, and improving rock climbing techniques, the rock climbing training apparatus may also be used for basic exercise and rehabilitation, such as when a user has permanently or temporarily lost complete or partial use of his/her legs.

Figure 1:
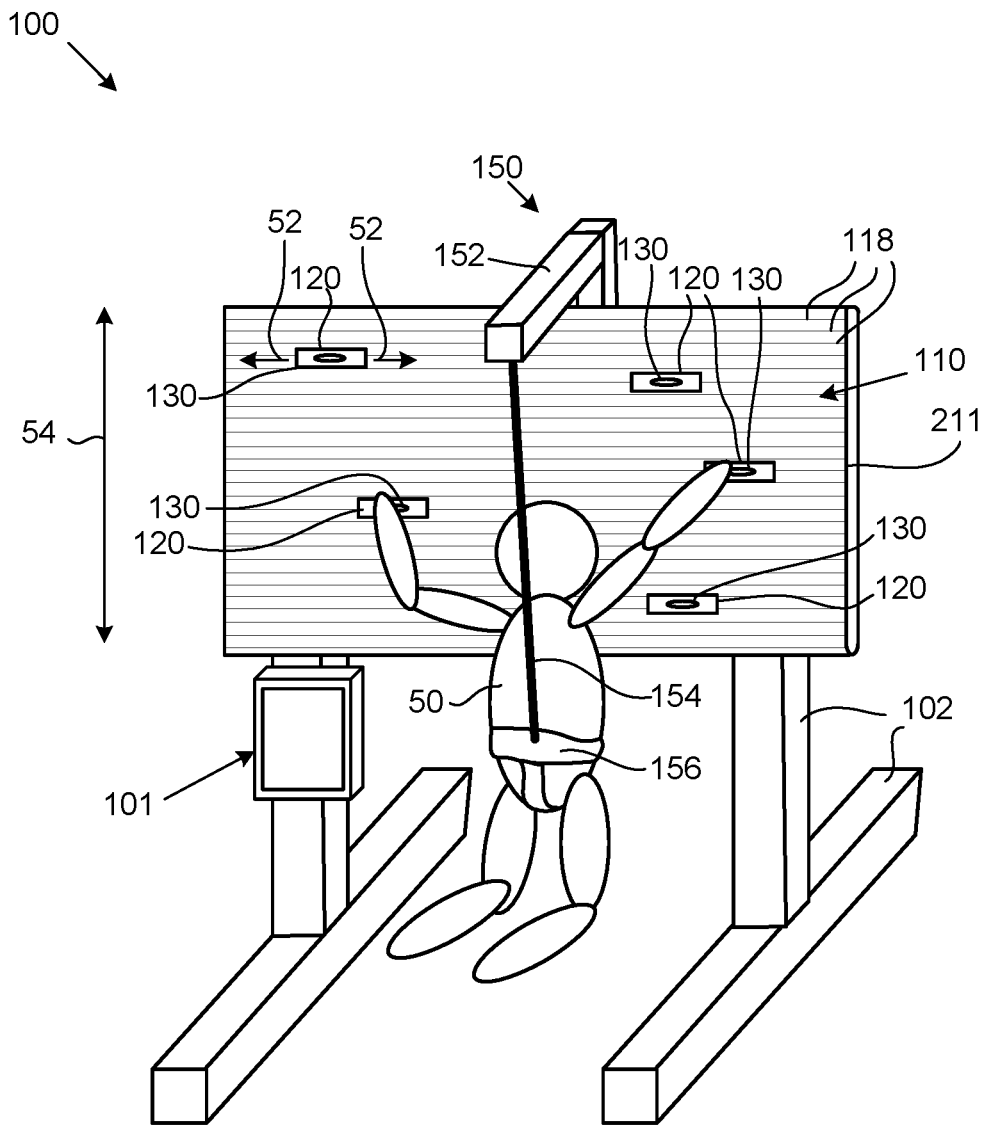
FIG. 1 is a schematic perspective view a rock climbing training apparatus, according to one embodiment.

FIG. 1 is a schematic perspective view one embodiment of the rock climbing training apparatus 100 (hereinafter "apparatus"). The apparatus 100 includes a driver that drives (e.g., rotates) a conveyor mechanism 110. The driver is an automated driver, such as a motor 112 (see, e.g., FIGS. 2 and 3), in some implementations and the driver is a manual driver, such as gravity acting on the user's mass, in other implementations. Throughout the present disclosure, the term "motor" refers generally to a device that is artificially powered to produce, impart, or give motion or action (e.g., an electric motor, a magnetic motor, a pump, a drive system, an engine, etc.). The conveyor mechanism 110 is coupled to a frame 102 configured to support the conveyor mechanism 110 above a ground level. In some implementations, the frame 102 includes feet that engage the ground level and are long enough to withstand overturning forces placed on the conveyor mechanism 110 when in use. In other implementations, the frame 102 is configured to be coupled to a vertical wall to support the conveyor mechanism 110 on the wall rather than on a ground level or floor.

The conveyor mechanism 110 has multiple bars 118 or slats. The bars 118 are rigid and strong enough to support a substantial portion of the weight of a user without permanent deformation. The bars 118 can be any of various elongate elements. The bars 118 extend lengthwise across a width of the conveyor mechanism 110 and are movably coupled to and retained by at least one continuous track 211 of the apparatus 100. The at least one track 211 is continuous because it has no beginning or end and as such forms an enclosed loop. In one implementation, the at least one track 211 defines a groove within the bars 118 are retained and along with the bars 118 move. The bars 118 may include coupling elements that are fixed to the bars 118 and are slidably enageable with the at least one track 211. In one implementation, the apparatus 100 includes two opposing continuous tracks 211 at each end of the bars 118, with respective ends of the bars 118 retained by and movable along the continuous tracks 211. Generally, the at least one track 211 is substantially rigid and strong so as to provide a support structure to which the bars 118 are movably supported. With the bars 118 movably retained by the at least one track 211, the shape of the at least one track 211 defines the shape of the path of the bars 118 as they rotate along the at least one track 211. To maintain the spacing of the bars 118 relative to each other, the bars 118 can be coupled to each other by links that prevent separation of the bars 118 relative to each other but allow the bars 118 to rotate relative to each other, such as to facilitate movement of the bars 118 about the curves of the tracks 211. The links may act as the coupling elements to enable slidable engagement with the at least one track 211.

The conveyor mechanism 110 also includes carriage components 120 moveably coupled to the bars 118. The carriage components 120 are able to move back and forth in a lateral direction 52, perpendicular to a height of the conveyor mechanism 110 or the vertical direction 54, along the bars 118. Attached to each carriage component 120 is a hold 130 or grip that is sized and shaped to be grasped by the user 50. The holds 130 may be similar to those used on artificial rock climbing walls known in the art. The capability of the carriage components 120 to move laterally along the bars 118 facilitates adjustment of the lateral position of the carriage components 120, thus enabling variations in the user's hand-positions while performing rock climbing exercises. Additional details relating to lateral adjustment of the carriage components 120 and holds 130 are described below with reference to FIGS. 2, 3, and 9.

As presented above, the bars 118 extend across a width of the conveyor mechanism 110 in the lateral direction 52, which is substantially perpendicular to the vertical direction 54. The vertical direction 54 is defined herein as a direction extending parallel to the longitudinal movement of the continuous rotatable track 211 (see, e.g., FIG. 2). In other words, the vertical direction 54 is parallel to the broad face of the conveyor mechanism 110 and perpendicular to a rotational axis of the conveyor mechanism 110. Thus, the vertical direction 54 does not necessarily mean perpendicular to the ground nor does it necessarily mean parallel to a gravity vector, as the conveyor mechanism 110 is tiltable relative to the ground to change the grade of the climbing exercise in some implementations. For example, the conveyor mechanism 110 may be adjustable to pivot or tilt (e.g., around tilt mechanism 186 having a fixed axis), either manually or via an automated/pre-programmed procedure, thereby allowing the user to change the incline of the conveyor mechanism 110 and thus experience many different climbing scenarios (e.g., gradual incline, vertical, or inverted).

The embodiment of the apparatus 100 depicted in FIG. 1 also includes a body support mechanism 150 that can be configured to at least partially support the body weight of the user 50. The body support mechanism 150 includes extension framework 152, a cable 154 (e.g., an elastic chord, such as a paracord), and a harness 156 that engages the user 50 and suspends the user in the air above a ground plane. The framework 152 is fixed to the frame 102 in some implementations. According to the depicted embodiment, the harness 156 wraps around the waist or torso of the user 50. In another embodiment, the harness 156 engages the feet or knees of the user 50. In another embodiment, the harness is a simple strap or a support member that allows a user to quickly engage with and disengage from the apparatus 100. For example, the harness may be a knee strap or a knee support platform, thus allowing two or more users to quickly and easily take turns using the apparatus 100. The body support mechanism 150 may include a tensioning assembly that allows the user 50 to change the magnitude of supportive force applied to the user 50, thereby determining the degree of difficulty of the climbing exercise. For example, beginners may configure the body support mechanism 150 to support more than 50% of the user's body weight while more advanced users can decrease the supportive force or not use the body support mechanism 150 altogether.

In the depicted embodiment, the apparatus 100 is intended only to be used for upper body climbing, thus allowing the overall height of the conveyor mechanism 110 to be comparatively less than other rotating walls. With comparatively reduced overall height, the apparatus 100 can be used in standard sized rooms and does not require vaulted ceilings. In another embodiment, however, the apparatus 100 can be configured such that the conveyor mechanism 110 has a height that allows the user 50 to use his arms and legs in the climbing exercise. For example, the user 50 may engage hands and/or legs on the holds 130. In yet another embodiment, the apparatus is large enough that multiple users may use the apparatus 100 simultaneously.

Figure 2:
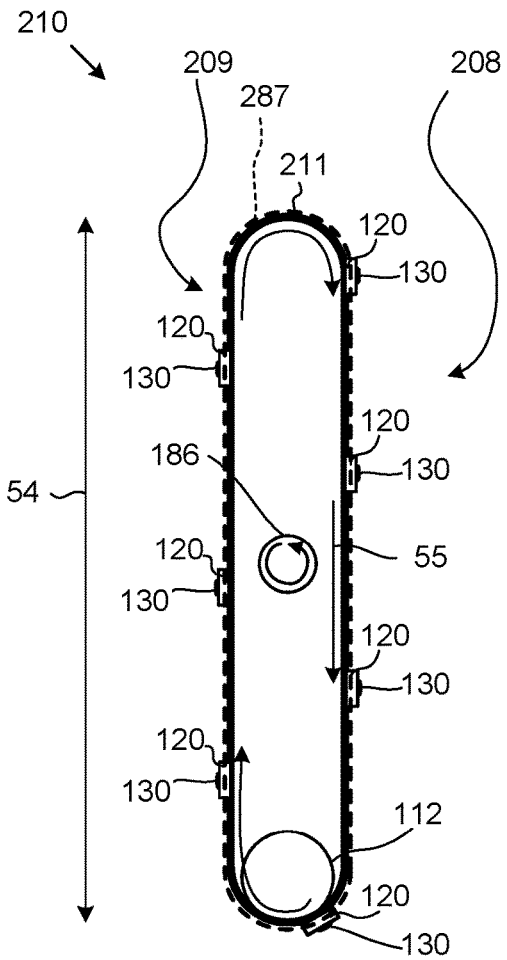
FIG. 2 is a side view of a conveyor mechanism with a continuous rotatable track having an obround shape, according to one embodiment.
Figure 3:
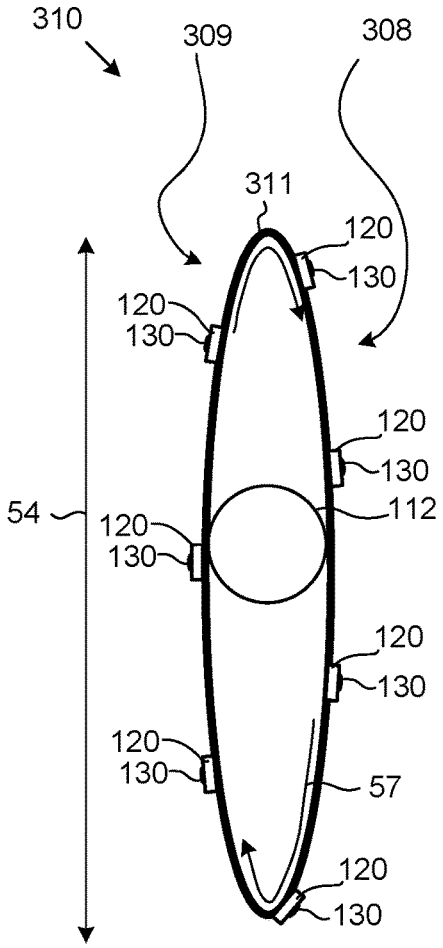
FIG. 3 is a side view of another embodiment of the conveyor mechanism showing the continuous rotatable track having an ovular shape.

FIGS. 2 and 3 are side views of different embodiments of a conveyor mechanism 210, 310. The conveyor mechanisms 210, 310 are analogous to the conveyor mechanism 110, with like numbers referring to like features. More specifically, FIG. 2 shows the conveyor mechanism 210 with a continuous track 211 having an obround shape (racetrack-like shape) and FIG. 3 shows the conveyor mechanism 310 with a continuous track 311 having an ovular shape. It is expected that the continuous track of the conveyor mechanism may have other shapes not shown or described herein, and that such other shapes fall within the scope of the present disclosure. For reference, FIGS. 2 and 3 also show the vertical direction 54 and the rotational direction 55, 57 of the bars 118 (not shown in FIGS. 2 and 3) as they collectively rotate along the respective continuous tracks 211, 311. As shown, the carriage components 120 and attached holds 130 that are moving across front sides 208, 308 of the conveyor mechanisms 210, 310, respectively, are traveling in a downward direction while the carriage components 120 and attached holds 130 that are moving across back sides 209, 309 of the conveyor mechanisms 210, 310, respectively, are traveling in an upward direction.

As described in greater detail below, in one embodiment the lateral position of the carriage components 120 along the bars 118 may be adjusted automatically by a control module as the carriage components 120 are moving upward across the back side 209, 309 of the conveyor mechanism 210, 310. In another embodiment, the lateral position of the carriage components 120 along the bars 118 may be manually adjusted by a personal trainer/assistant as the carriage components 120 are moving upward across the back side 209, 309 of the conveyor mechanism 210, 310. In such embodiments, the lateral position of the carriage components 120 and holds 130 are manually changeable so that the user experiences a different climbing situation as the bars 118, carriages 120, and holds 130 rotate. Also, the vertical spacing between the carriage components 120 may be adjusted by adding or removing carriage components 120, thus varying the vertical reach for the users. Additional details relating to the continuous tracks 211, 311 and drive mechanisms for driving the bars 118 along the tracks are included below with reference to FIGS. 4 and 5.

Figure 4:
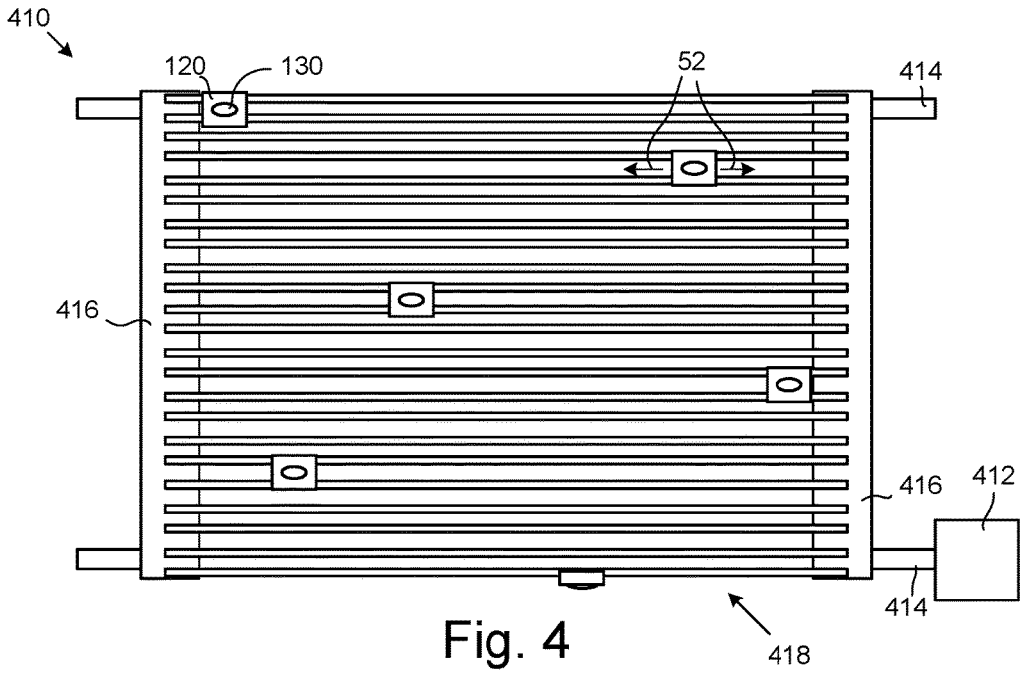
FIG. 4 is a front view of the conveyor mechanism, according to one embodiment.
Figure 5:
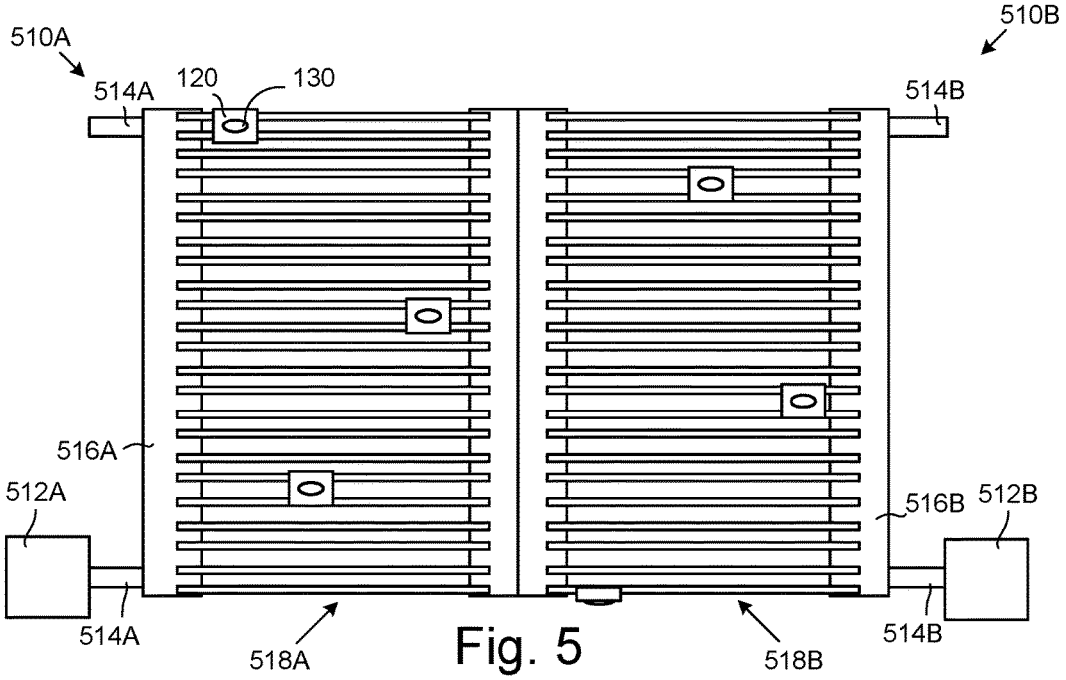
FIG. 5 is a front view of the conveyor mechanism, according to another embodiment.

FIGS. 4 and 5 are front views, showing front sides, of different embodiments of conveyor mechanisms 410, 510A, 510B. The conveyor mechanisms 410, 510A, 510B are analogous to the conveyor mechanism 110, with like numbers referring to like features. More specifically, the conveyor mechanism 410 in FIG. 4 is coupled to and driven by a motor 412. The motor 412 drives rotation of one or more rotatable shafts 414. One or more belt drive components 416 are engaged with the bars 418 so that the rotational motion of the belt drive components 416 created by the motor 412 is conveyed to the bars 418 to rotate the bars 418 in a closed loop path along one or more continuous tracks. As used herein, the belt drive component 416 can be any of various belts, chains, cables, wires, ropes, etc. that are engageable with and rotatable by a driving mechanism (e.g., motor) in a continuous fashion to transmit mechanical power to the bars 418. In one embodiment, the belt drive component 416 is integrated into the coupling elements that couple together the bars 418. In one embodiment, one of the rotatable shafts 414 is directly powered by the motor 412 while other rotatable shafts 414 are indirectly powered by the motor 412 via one or more belt drive components 416. In another embodiment, two or more of the rotatable shafts 414 may be directly powered by a respective one of at least two motors 412.

As shown, each end of the bars 418 is attached or mounted to the belt drive components 416. The bars 418 may be permanently attached to the belt drive components 416 via weldment or other suitable means. In other embodiments, the conveyor mechanism 410 has a single belt drive component 416, such as positioned proximate a midpoint of the bars 418 and the bars 418 are attached to the single belt drive component 416 at the midpoint of the bars 418.

FIG. 5 shows two conveyor mechanisms 510A, 510B, one for each hand of the user 50. In other words, the left conveyor mechanism 510A includes holds 130 that are positioned to be grasped by the user's 50 left hand while the right conveyor mechanism 510B includes holds 130 that are positioned to be grasped by the user's 50 right hand. Each of the conveyor mechanisms 510A, 510B has its own motor 512A, 512B, rotatable shafts 514A, 514B, and belt drive components 516A, 516B. In such an embodiment, the rotational speed of the conveyor mechanisms 510A, 510B may be independently adjusted to further vary the climbing situations encountered by the user 50 while using the apparatus. Additional components may be included with the conveyor mechanism, such as a gearbox, etc.

Figure 6:
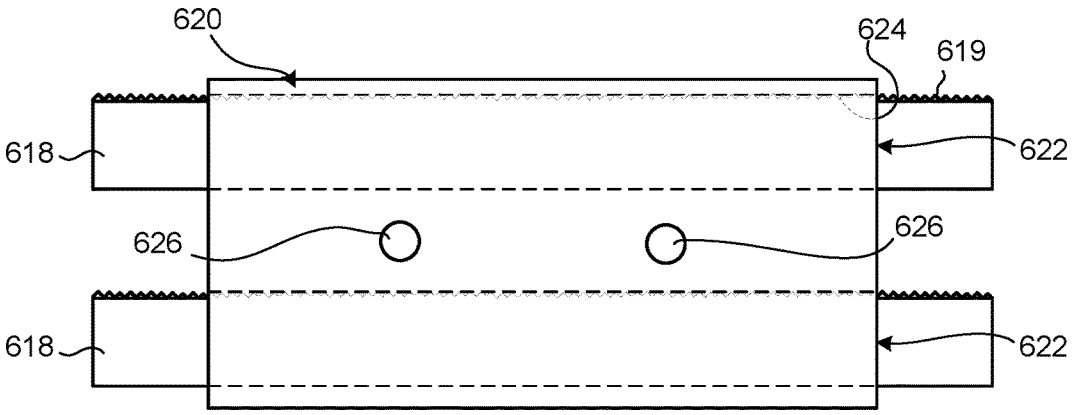
FIG. 6 is a front view of a carriage component coupled to bars, according to one embodiment.
Figure 7:
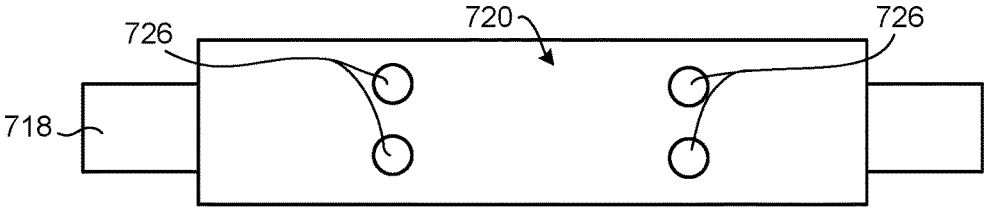
FIG. 7 is a front view of another embodiment of the carriage component.

FIGS. 6 and 7 show front views of different embodiments of carriage components 620, 720, respectively, of conveyor mechanisms analogous to the conveyor mechanism 110, with like numbers referring to like features. The carriage components 620, 720 are examples of the carriage components of the conveyor mechanisms of the present disclosure, such as the carriage components 120 of the conveyor mechanism 110. FIG. 6 shows the carriage component 620 spanning two bars 618. However, in some implementations, the carriage component 620 can span three or more bars 618. The carriage component 620 has pass-through holes 622 through which the bars 618 extend. In one embodiment, as depicted in FIG. 6, the top surfaces of the bars 618 have engagement features 619 (e.g., teeth, grooves, etc.) that engage corresponding or conforming engagement features 624 on the top side of the pass-through hole 622. In such an embodiment, weight of the carriage component 620 pressing down on the bars 618 causes the engagement features 619 on the bars 618 to engage the engagement features 624 on the carriage component 620, thus preventing lateral slippage while the carriage component moves downward along a front side of the conveyor mechanism. As the carriage component transitions over to a back side of the conveyor mechanism, weight of the carriage component 620 presses down on the smooth side of the bars 618, thus allowing the carriage component 620 to slide laterally to a new position as the carriage component moves upward along a back side of the conveyor mechanism. In contrast to FIG. 6, in the alternative embodiment shown in FIG. 7, the carriage component 720 is moveably coupled to a single bar 718 as opposed to two bars. Although not shown, the carriage component 720 and the single bar 718 may include respective engagement features to prevent lateral slippage while the carriage component 720 moves downward across a front side of the conveyor mechanism and to allow lateral slippage while the carriage component 720 moves upward across a back side of the conveyor mechanism.

When lateral slippage is allowed, such as when the carriage components 620, 720 are moving upward along a backside of a conveyor mechanism, the carriage components 620, 720 may move along the respective bar(s) 618, 718 by sliding. In another embodiment, ball bearings, rollers, roller clamps (e.g., similar to how a roller coaster car is movably coupled to a roller coaster track), etc. may be used to facilitate the lateral movement of the carriage components 620, 720. The carriage components 620, 720 may also include various fastener features 626, 726 (e.g., holes, protrusions, fasteners, etc.) to which holds (e.g., holds 830 of FIG. 8) may be attached.

Figure 8:
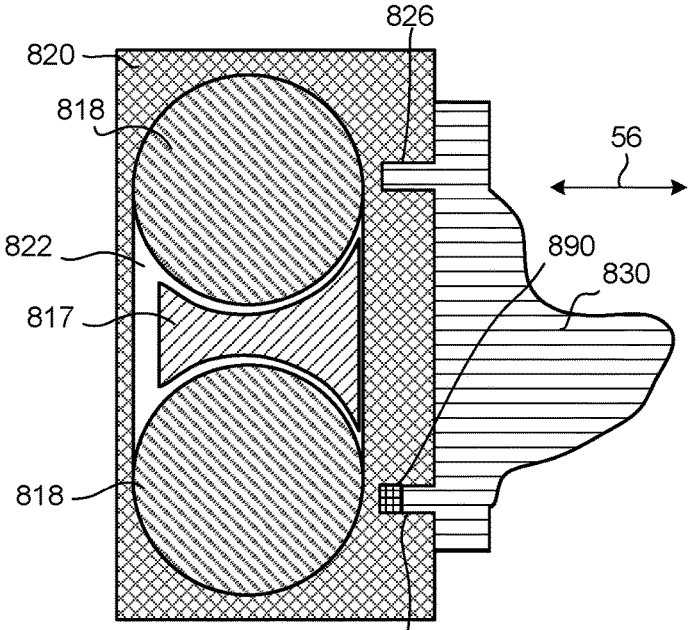
FIG. 8 is a cross-sectional side view of a hold coupled to the carriage component, according to one embodiment.

FIG. 8 is a cross-sectional side view of one hold 830 coupled to a carriage component 820, according to one embodiment. As shown, the carriage component 820 includes a single pass-through hole 822 through which two bars 818 extend. According to the embodiment depicted in FIG. 8, when gaps between adjacent bars are large enough, one or more spacers 817 are disposed between adjacent bars 818 to prevent fingers and clothing from being pinched between adjacent bars. While the benefit of the spacer 817 shown in FIG. 8 may not be immediately apparent since the carriage component 820 is surrounding the spacer 817, the spacers 817 are disposed between all of the bars and the spacers 817 extend across the lateral width of the conveyor mechanism. In other words, the spacers 817 are not components of the carriage component 820 and may or may not move laterally with the carriage component 820. In one embodiment, the carriage component 820 may have a comparatively larger pass-through hole than the one depicted in FIG. 8 in order to decrease friction and allow easier lateral repositioning of the carriage component 820. Also, the carriage component 820 may have at least a portion of its body that is flexible or hinged, thereby allowing the carriage component 820 to flex or bend as the carriage component 820 moves around the continuous track.

In one embodiment, each hold 830 is moveable relative to the carriage component 820 in a protruding direction 56 perpendicular to the vertical direction 54 and the lateral direction 52. In other words, how far each hold 830 protrudes from the carriage component 820 and thus the bars 818 may be manually or automatically adjusted, such as via the actuation of a fastener or set screw. However, in some embodiments, each hold 830 is non-movably fixed relative to the carriage component 820. According to certain implementations, the holds 830 are interchangeable with holds of other types or configurations. For example, holds 830 that are configured for easy gripping (e.g., friction-inducing surface features or coatings, bulbous features, etc.) may be replaced with holds 830 that are configured for harder gripping or griping using different techniques or muscles (e.g., balls, bars, etc.)

In some implementations, the carriage component 820 or the hold 830 may include a pressure sensor (e.g., pressure sensor 890) that detects whether the user 50 is grasping the carriage component 820 and the hold 830 to support at least a portion of the weight of a user 50. If the pressure sensors of the apparatus do not detect a portion of a user's weight, the apparatus may be configured to automatically deactivate as a safety feature.

Figure 9:
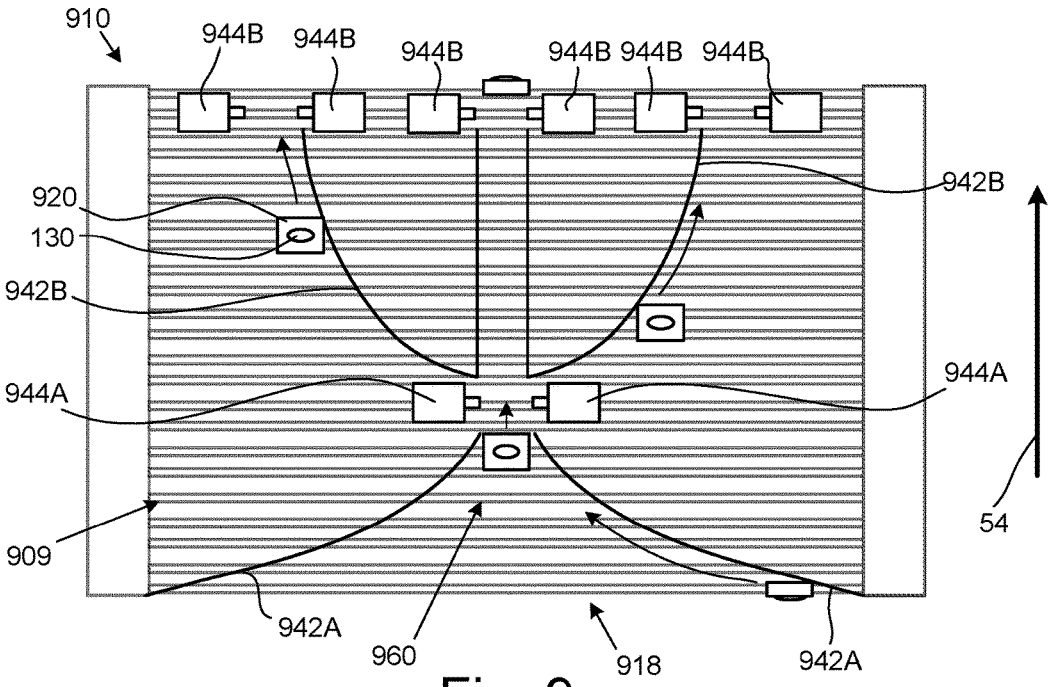
FIG. 9 is a front view a repositioning system mounted to a back side of the conveyor mechanism for laterally repositioning the carriage components, according to one embodiment.

FIG. 9 is a front view a repositioning system 960 mounted to a back side 909 of a conveyor mechanism 910 for laterally repositioning the carriage components 920, according to one embodiment. In the depicted embodiment, the repositioning system includes a plurality of guide rails 942A, 942B disposed on the back side of the conveyor mechanism 910. As the plurality of carriage components 920 move upwards in the vertical direction 54 along the back side 909 of the conveyor mechanism 910, the carriage components 920 engage the guide rails 942A, 942B. The guide rails 942A, 942B cooperate to laterally move the carriage components 920 to predetermined positions. According to one embodiment, the repositioning system 960 also includes translational actuators 944A, 944B that contact the carriage components 920 to push them laterally along the bars 918 into desired lateral positions before the carriage components 920 are rotated to the front side of the conveyor mechanism, fall into engagement with engagement features on the bars 948, and move downwardly along the front side, as described in more detail above. The translational actuators 944A, 944B may be any device that can affect linear movement (e.g., servo motors, solenoid actuators, etc.). In one embodiment, instead of the guide rails 942A, 942B directly contacting the body of the carriage components 920, the carriage components 920 may include a guide pin or other feature that protrudes from the body of the carriage component 920 to engage the guide rails 942A, 942B.

According to the specific embodiment depicted in FIG. 9, first guide rails 942A disposed near a bottom portion of the back side 909 of the conveyor mechanism 910 are configured to move all of the carriage components 920 initially to a laterally central position. First translational actuators 944A on either side of the carriage components 920 are used to push the carriage components 920 to one side or the other. Alternatively, the carriage component 920 may continue upward without being pushed by the first translational actuators 944A. Additional guide rails (not shown) can further facilitate the initial repositioning of the carriage components 920 either on a left side, a center potion, or a right side of the conveyor mechanism 910. Second translational actuators 942B, disposed near a top portion of the back side 909 of the conveyor mechanism 910, can be used to further laterally position (e.g., fine tune the lateral position of) the carriage components 920 along the bars 918 in order to further customize the positions of the carriage components 920 on the bars 918 in advance of the carriage components 920 moving downward on the front side of the conveyor mechanism 910. The conveyor mechanism 910 can include any number of guide rails and any number of translational actuators.

The apparatus 100 may also include a controller 101 through which the user 50 can control the operation of the apparatus 100. For example, one or more of the rotational speed of the conveyor mechanism 110, the lateral positioning of the carriage components 120 (e.g., randomized pattern, repeating pattern, progressive pattern, etc.), the incline of the conveyor mechanism 110, and the magnitude of the supportive force for the body weight support mechanism are possible parameters that the controller 101 can control, among others. Further, the controller 101 may be configured to receive input from the user regarding the user's weight, arm span, height, age, body mass index, etc. and the controller may be configured to automatically recommend or implement certain operating parameters. In one embodiment, the controller 101 may be configured to automatically change (e.g., randomize) one or more of the rotational speed of the conveyor mechanism 110, the lateral positioning of the carriage components 120, the incline of the conveyor mechanism 110, and the magnitude of the supportive force for the body weight support mechanism, thereby enabling the user to experience many different and unique exercises and thus facilitating the development of the user's climbing skills. For example, the controller 101 may be pre-programmed (or may be able to incorporate additional, add-on, or customized programming) with different climbing scenarios. In one embodiment, the user may be able to select a specific climbing scenario from a list of climbing scenarios based on climbing difficulty, an actual rock climbing formation in nature, etc.

In one embodiment, the controller 101 may include a voice recognition module and/or a voice coach module. For example, the apparatus 100 may include a microphone and the voice recognition module may receive spoken/audible requests via the microphone from the user and the voice recognition module may generate operating instructions for the apparatus based on the user's spoken requests. The apparatus 100 may also include one or more speakers and the voice coach module of the controller 101 may emit audible instructions and coaching relating to the climbing exercise. For example, the voice coach module may detect patterns in the user's climbing exercise and may provide audible, spoken instructions based on the detected patterns of the user for the purpose of improving the user's technique, etc. The speakers of the apparatus may also enable the user to play music via a wired connection (e.g., headphone jack) or via a wireless connection (e.g., ®Bluetooth).

In one embodiment, the controller 101 may include a touch screen or other user interface that allows the user to interact with the controller 101. In another embodiment, the user may interact with the controller 101 via a smart phone application, etc. In a further embodiment, the apparatus 100 may also include a separate display monitor or a screen that shows actual climbing environments, thereby allowing the user to visualize an actual climb while exercising/training. In one embodiment, a user may save a certain climbing scenario (whether pre-programmed or randomized scenario) using the control 101. The user may subsequently repeat the saved climb and/or may invite others (e.g., via social media) to try the same climb. In one embodiment, the controller 101 may include a competition mode that allows multiple users to compete against each other. For example, two different users, whether competing in the same room or whether competing remotely using an internet connection, may perform the same climbing exercise (e.g., a saved climb) to see who is faster and/or who can go the farthest. The controller 101 may keep track of which user "climbed" at a higher speed or which user "climbed" a greater distance, etc. In the competition mode, the users may compete simultaneously or the results of one of the users may be saved and compared to the results of another user that performs the climbing exercise at a different time. Also recognized is an embodiment that includes a video or still camera that captures videos or images of the user exercising on the apparatus, which can be used by the user or shared with other users for instructional or competitive purposes.

In a further embodiment, the apparatus 100 may include a surface material (see, e.g., surface material 287 of FIG. 2) that is coupled to and at least partially covers the plurality of bars. The surface material may include strips of material that are coupled to the spacers and that collectively create an undulating surface that resembles a face of a natural rock formation. Such surface material may not only create the appearance of climbing an actual rock formation, but may be rigid enough to function as an obstacle, thus simulating situations and conditions that may arise while rock climbing a natural rock formation and thus promoting the effectiveness of the rock climbing training. In one embodiment, the apparatus 100 may be configured to resemble (in appearance and/or climbing parameters) real-life climbing experiences (e.g., by mimicking the size and/or spacing of the holds). In yet certain implementations, the bars may be replaced with a sheet (or other configuration) of material to which the carriage components are movably attachable and which is strong enough to support the full weight or partial weight of a user.

Although the driver of the conveyor mechanism described herein has been described as a motor in one embodiment, in another embodiment, the driver can be gravity in cooperation with the user's own mass. In such an embodiment, the apparatus includes a restrictor or braking mechanism coupled to the conveyor mechanism. Upon gripping a hold, the weight of the user acts to rotate the bars (e.g., pull the bars on the front side of the conveyor mechanism downward and correspondingly urge the bars on the back side of the conveyors upward). The restrictor is resistively engaged with the bars, such as via a belt drive component coupled to the bars, to limit the rotation of the bars caused by the user's weight. In this manner, the user's weight drives the rotation of the bars and the restrictor regulates the rotational speed of the bars. The restrictor can be manually or automatically controlled.

According to one embodiment, a method of exercising a user includes rotating a plurality of bars down a first side in a first direction and rotating the plurality of bars up a second side in a second direction opposite the first direction. The second side is opposite the first side. For example, the first side faces a direction opposite the second side. The method also includes movably coupling a plurality of holds to the plurality of bars. Furthermore, the method includes, moving the plurality of holds in a third direction, perpendicular to the first direction and the second direction, along the plurality of bars into first positions while the plurality of bars are rotating up the second side in the second direction. The method also includes releasably fixing the plurality of holds in the first positions while the plurality of bars are rotating down the first side in the first direction. The first position of one hold may be different than the first position of another hold. The method may also include moving the plurality of holds in the third direction along the plurality of bars from the first positions into second positions, different than the first positions, while the plurality of bars are rotating up the second side in the second direction. Additionally, the method can also include releasably fixing the plurality of holds in the second positions while the plurality of bars are rotating down the first side in the first direction. The second position of one hold may be different than the second position of another hold.

In the above description, certain terms may be used such as "up," "down," "upper," "lower," "horizontal," "vertical,"

"left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. An exercise apparatus, comprising:

a conveyor mechanism comprising a continuous track and a plurality of bars movable along the continuous track in a closed loop path, wherein:

the plurality of bars extend lengthwise in a lateral direction across a width of the conveyor mechanism;

the conveyor mechanism has a front side and a back side, opposite the front side;

the plurality of bars move in a downward direction along the front side of the conveyor mechanism and in an upward direction along the back side of the conveyor mechanism; and the upward direction and the downward direction are perpendicular to the lateral direction;

a plurality of carriage components movable along the plurality of bars in the lateral direction; and at least one hold coupled to each carriage component of the plurality of carriage components.

2. The exercise apparatus of claim 1, wherein:

the plurality of carriage components is movable along the plurality of bars in the lateral direction when the plurality of bars are moving in the upward direction along the back side of the conveyor mechanism; and the plurality of carriage components is non-movable along the plurality of bars in the lateral direction when the plurality of bars are moving in the downward direction along the front side of the conveyor mechanism.

3. The exercise apparatus of claim 2, further comprising a repositioning system on the back side of the conveyor mechanism configured to laterally reposition the plurality of carriage components along the plurality of bars.

4. The exercise apparatus of claim 3, wherein:

the repositioning system comprises a plurality of guide rails;

the plurality of carriage components engage the guide rails as the plurality of carriage components move with the plurality of bars in the upward direction along the back side of the conveyor mechanism; and the guide rails urge movement of the plurality of carriage components in the lateral direction along the plurality of bars.

5. The exercise apparatus of claim 4, wherein the repositioning system further comprises at least one translational actuator selectively operable to laterally pushes the plurality of carriage components along the plurality of bars.

6. The exercise apparatus of claim 4, wherein:

each bar of the plurality of bars comprises first engagement features on only a first side of the bar;

each carriage component of the plurality of carriage components comprises second engagement features; and the first engagement features of each bar and the second engagement features of each carriage component are engageable, only when the plurality of bars are moving in the downward direction along the front side of the conveyor mechanism, to prevent relative movement between the bar and the carriage component.

7. The exercise apparatus of claim 1, wherein the continuous track of the conveyor mechanism has one of an obround shape or an ovular shape.

8. The exercise apparatus of claim 1, wherein the plurality of carriage components are slidably engaged with the plurality of bars.

9. The exercise apparatus of claim 1, further comprising spacers coupled to the plurality of bars, wherein the spacers are disposed between adjacent bars of the plurality of bars to prevent fingers and clothing from being pinched between adjacent bars.

10. The exercise apparatus of claim 1, further comprising a body support mechanism configured to at least partially suspend a user in the air.

11. The exercise apparatus of claim 10, wherein the body support mechanism is adjustable to provide different magnitudes of supportive force.

12. The exercise apparatus of claim 10, wherein the body support mechanism is configured to engage at least one of a waist of the user, knees of the user, or torso of the user.

13. The exercise apparatus of claim 10, wherein the body support mechanism comprises a harness.

14. The exercise apparatus of claim 1, wherein:

the conveyor mechanism is a first conveyor mechanism;

the exercise apparatus further comprises a second conveyor mechanism; and a rotational speed of the first and second conveyor mechanisms are independently adjustable.

15. The exercise apparatus of claim 1, wherein at least one of each carriage component or each hold comprises a pressure sensor configured to determine if a user is gripping the hold.

16. The exercise apparatus of claim 1, wherein each hold is moveable, relative to the carriage component to which the hold is coupled, in a protruding direction perpendicular to the upward direction, the downward direction, and the lateral direction.

17. The exercise apparatus of claim 1, further comprising a surface material coupled to and at least partially covering the plurality of bars.

18. The exercise apparatus of claim 1, further comprising a tilt mechanism defining a fixed axis, and wherein the conveyor mechanism is tiltable about the fixed axis of the tilt mechanism.

19. A method of exercising a user, comprising:

rotating a plurality of bars down a first side in a first direction;

rotating the plurality of bars up a second side in a second direction opposite the first direction;

movably coupling a plurality of holds to the plurality of bars;

moving the plurality of holds in a third direction, perpendicular to the first direction and the second direction, along the plurality of bars into first positions while the plurality of bars are rotating up the second side in the second direction; and releasably fixing the plurality of holds in the first positions while the plurality of bars are rotating down the first side in the first direction.

20. The method of claim 19, further comprising:

moving the plurality of holds in the third direction along the plurality of bars from the first positions into second positions, different than the first positions, while the plurality of bars are rotating up the second side in the second direction; and releasably fixing the plurality of holds in the second positions while the plurality of bars are rotating down the first side in the first direction.

* * * * *